US005331690A

United States Patent [19]

Pourcier

[11] Patent Number: 5,331,690

[45] Date of Patent: Jul. 26, 1994

[54] DUAL CONTROL FLUSHING MECHANISM, ENABLING COMPLETE OR PARTIAL EVACUATION OF A TOILET TANK TO BE OPERATED SELECTIVELY

[75] Inventor: Michel Pourcier, Marseille, France

[73] Assignee: Societe Phoceene De Matieres Plastiques (S.P.M.P.), Marseille, France

[21] Appl. No.: 922,862

[22] Filed: Jul. 31, 1992

[30] Foreign Application Priority Data

Aug. 9, 1991 [FR] France ..... 9110383

[51] Int. Cl.[5] ..... E03D 5/09; E03D 1/00

[52] U.S. Cl. ..... 4/410; 4/378; 4/415; 4/324

[58] Field of Search ..... 4/327, 390, 391, 378, 4/395, 403, 326, 405, 410, 413, 414, 415, 379, 381, 383, 384, 394, 397, 398, 400, 324–326, 411, 412

[56] References Cited

U.S. PATENT DOCUMENTS

| | | | |
|---|---|---|---|
| 3,080,567 | 3/1963 | King | 4/327 |
| 3,186,007 | 6/1965 | Falotico | 4/327 |
| 3,906,554 | 9/1975 | Johnson | 4/327 |
| 3,958,281 | 5/1976 | Remmel | 4/327 |
| 4,304,014 | 12/1981 | Thompson | 4/410 |
| 4,566,140 | 1/1986 | Musgrove | 4/415 |
| 4,833,738 | 5/1989 | Scott | 4/326 |
| 4,956,880 | 9/1990 | Bailet | 4/378 |
| 5,003,644 | 4/1991 | Huang | 4/324 |
| 5,265,282 | 11/1993 | Schmucki | 4/325 |
| 5,265,283 | 11/1993 | Pourcier | 4/410 |

FOREIGN PATENT DOCUMENTS

| | | | |
|---|---|---|---|
| 580783 | 12/1985 | Australia . | |
| 0312750 | 4/1989 | European Pat. Off. | 4/415 |
| 3128614 | 2/1983 | Fed. Rep. of Germany | 4/415 |
| 3331047 | 6/1985 | Fed. Rep. of Germany | 4/415 |
| 2609297 | 7/1988 | France . | |
| 2621630 | 4/1989 | France . | |
| 2658844 | 8/1991 | France . | |
| 2658884 | 8/1991 | France . | |
| 2662723 | 12/1991 | France | 4/410 |
| 2665744 | 2/1992 | France | 4/378 |
| 2678300 | 12/1992 | France | 4/400 |

OTHER PUBLICATIONS

French Search Report and Annex (Apr. 16, 1992).

*Primary Examiner*—Henry J. Recla
*Assistant Examiner*—Greg Vidovich
*Attorney, Agent, or Firm*—Sandler, Greenblum & Bernstein

[57] ABSTRACT

Dual control flushing mechanism enables a user to select complete or partial flush of a toilet tank. The complete flush is obtained by lifting a mobile assembly containing a float, while maintaining the float intact. The partial flush is obtained by lifting the mobile assembly and simultaneously opening the float so that it fills with water and thereafter sinks, causing a blocking valve to engage and terminate the flushing process before a full flush has been effected.

21 Claims, 11 Drawing Sheets

DUAL CONTROL FLUSHING MECHANISM, ENABLING COMPLETE OR PARTIAL EVACUATION OF A TOILET TANK TO BE OPERATED SELECTIVELY

BACKGROUND OF THE INVENTION

1. Field of the Invention

The present invention is related to a flushing mechanism with dual controls enabling a complete or partial evacuation of the flushing tank, according to the user's choice.

2. Background and Related Information

Others have disclosed flushing mechanisms enabling the interruption, at will, of the evacuation of the flushing tank when one estimates that an adequate washing or rinsing of the bowl has been done, but before a total evacuation of all the water contained in said tank. See FR-A-2,609,297, FR-A-2,621,630, FR-A-2,658,844, and French Patent Application No. 90/06414. The interruption occurs before completion of the normal flushing process, in such a way that it is thus possible to obtain appreciable savings of water.

With the exception of the flushing system described in the document FR-A-2,609,297, the various devices proposed for obtaining the above described result have the disadvantage of necessitating two successive and spaced actions for control of the flushing mechanism. However, users or consumers do not always take the time, after having activated the control element the first time, of ensuring that an adequate rinsing of the bowl has been obtained before complete evacuation, in order to activate, a second time, the control element driving the interruption of the water flow, such that substantial quantities of water are often consumed uselessly.

The document FR-A-2,609,297 describes a flushing system whose aim is to obtain a water yield adapted to each use of the flush. However, this system implements a control device with two activating elements functioning by traction, and whose manipulation is especially clumsy. To obtain partial evacuation, one must, in fact, maintain one element pressed while the second is raised, and this during the entire duration of the partial evacuation.

The objective of the present invention is especially to overcome the necessity of activating the control element of the flushing mechanism twice to terminate the flushing process, so as to limit the quantity of water evacuated, without having to resort to complicated actions by the users.

The invention is particularly related to flushing mechanisms comprising a mounted, axially-displaceable assembly, comprising a valve for blocking the evacuation orifice of the tank, and stored in the lower portion of an overfilling tube or an overflow tube comprising an upper orifice and a lower orifice, the lower portion of such overflow tube being arranged or configured to constitute a float arranged above the valve, this float being submersible, and being equipped, to this end, with a blocking device which is axially and vertically moveable, this blocking device capable of being pressed against a seat formed by the edge of the lower orifice of the overflow tube, so as to stop entry of water in the float, or distanced from said seat under the impulsion of a pusher or stop element, so as to enable entry of water in said float driving the quick fall of such element and the interruption of the flushing process.

The invention further comprises two distinct push-button control systems. A first push-button control system includes a transmission device for lifting the mobile assembly. A second push-button control system comprises a transmission device enabling the positioning of the blocking device of the submersible float in the open position. Both of these control systems are arranged such that the activation of the lifting command of the mobile assembly does not result in any action on the displacement command of the blocking device of the submersible float, whereas the activation of the opening command of said blocking device automatically drives the activation of the lifting command of the mobile equipment.

According to another characteristic arrangement of the invention, the device comprises means for maintaining the displacement system of the blocking device of the submersible float in the open position of said blocking device, so that the filling of said float drives the fall of the latter element.

By virtue of the invention, the user or consumer can, in accordance with the quantity of water that he considers necessary to ensure adequate cleaning of the bowl, either obtain complete evacuation of the tank by activating the control system enabling the lifting of the mobile equipment of the flushing mechanism, or obtain partial evacuation of said tank, i.e., a partial evacuation of such tank, by activating the control system for opening the blocking device of the submersible float simultaneously driving the activation of the control system for lifting the mobile equipment.

The quantities of water evacuated by the implementation of one or the other of these flushing processes described herein above cannot be modified, while these processes cannot be interrupted, when they are activated, and this ensures that the bowl will be cleaned or rinsed well under all circumstances.

The aims, characteristics, and advantages mentioned above, and still others, will become more apparent upon reading the description that follows.

DETAILED DESCRIPTION OF THE INVENTION

Figure 1:
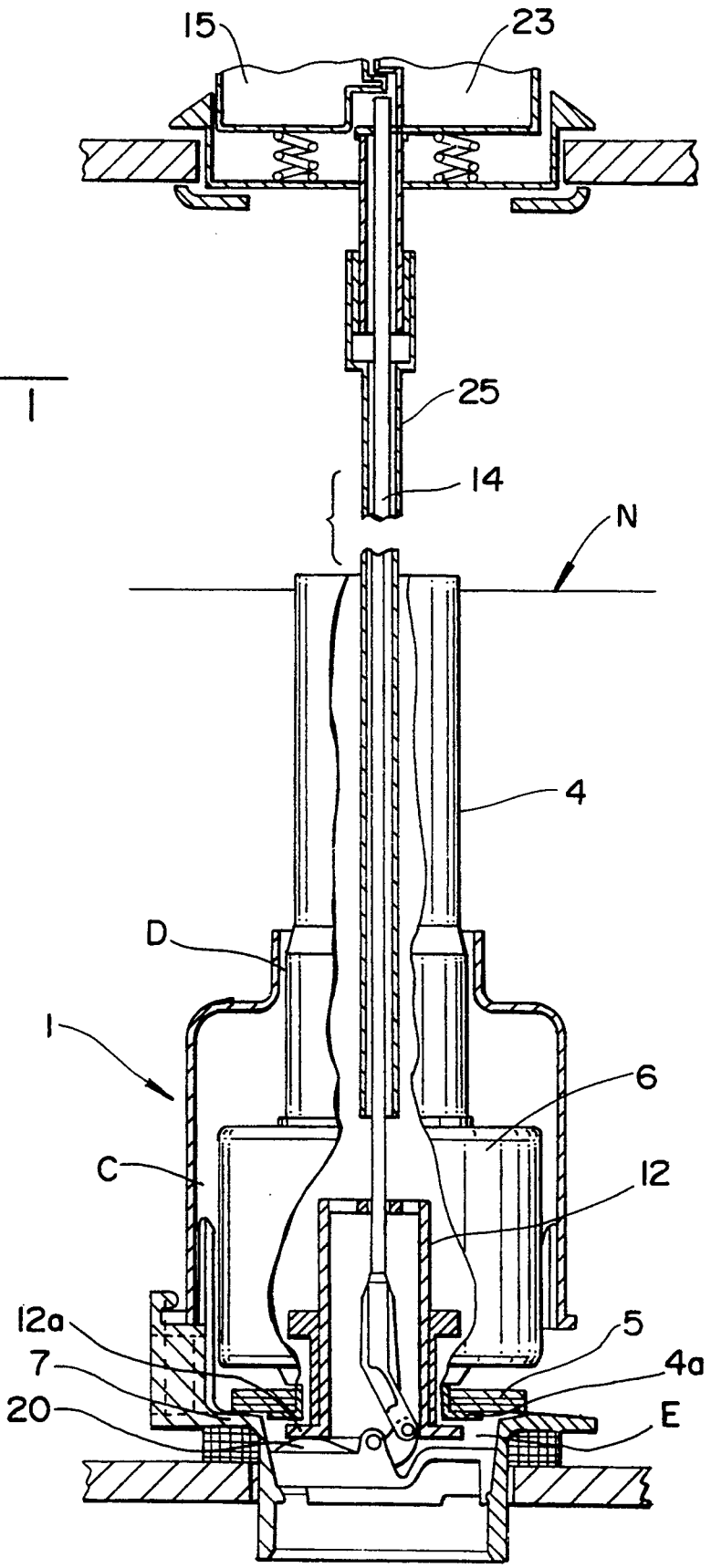
FIG. 1 is a longitudinal cross-sectional view of a first embodiment of an apparatus according to the invention, comprising a flushing tank in which the base and cover have only been partially represented, wherein the internal mechanism is in the resting position.
Figure 2:
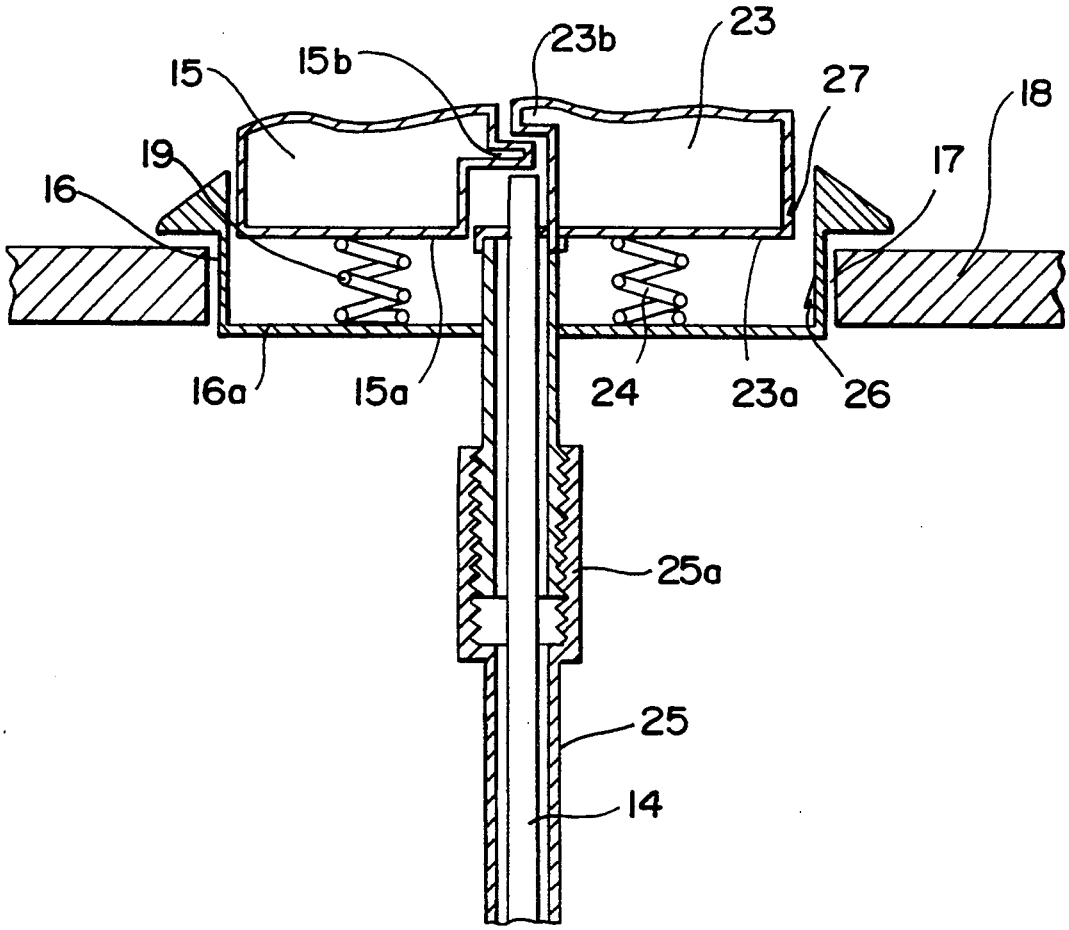
FIG. 2 is a longitudinal cross-sectional view at enlarged scale, of the upper portion of the apparatus illustrated in FIG. 1.
Figure 3:
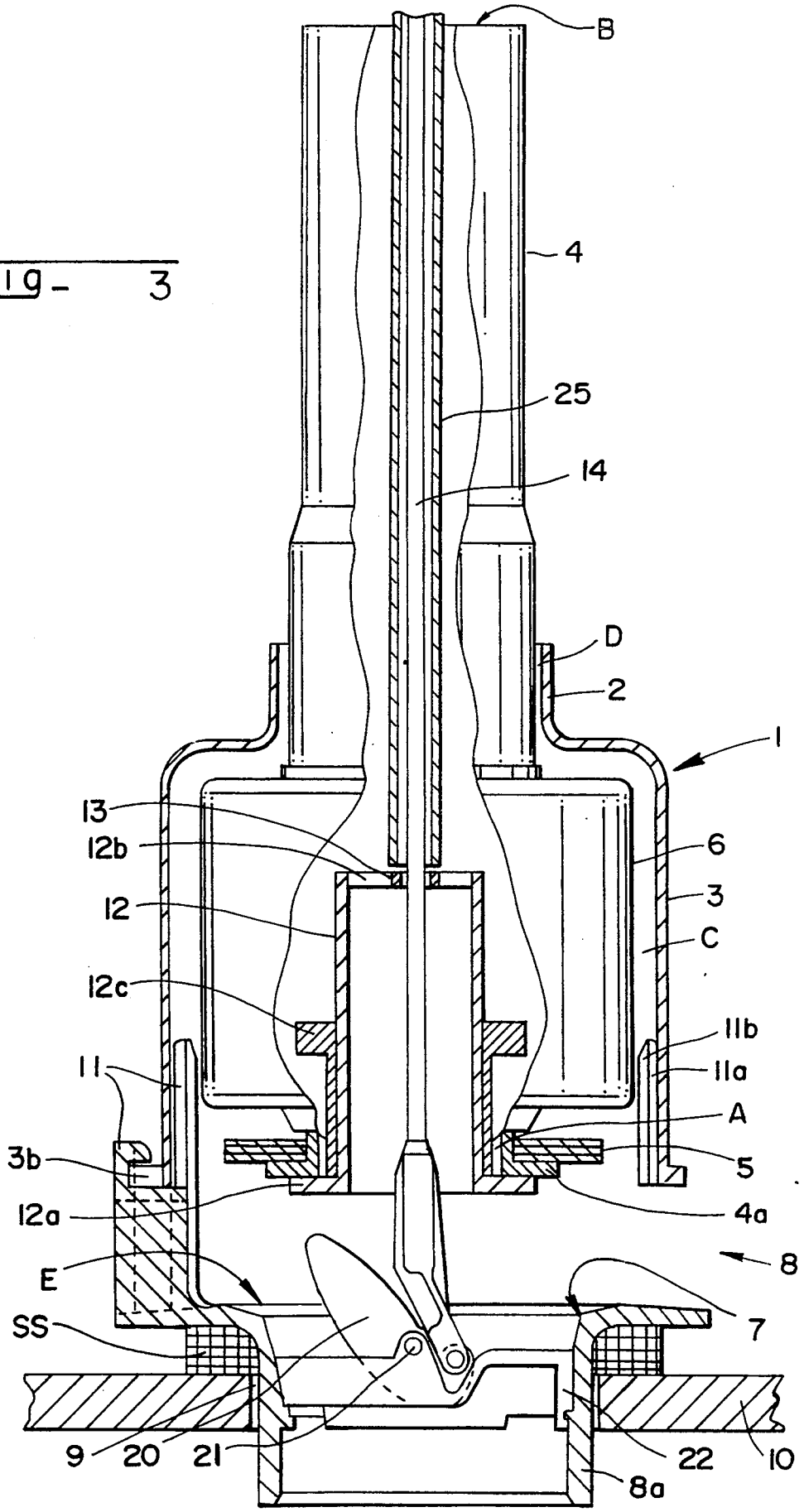
FIG. 3 is a longitudinal cross-sectional view at enlarged scale, of the lower portion of an apparatus in which the internal mobile assembly is represented in a position consequent to the activation of the control button for complete evacuation of the tank.
Figure 4:
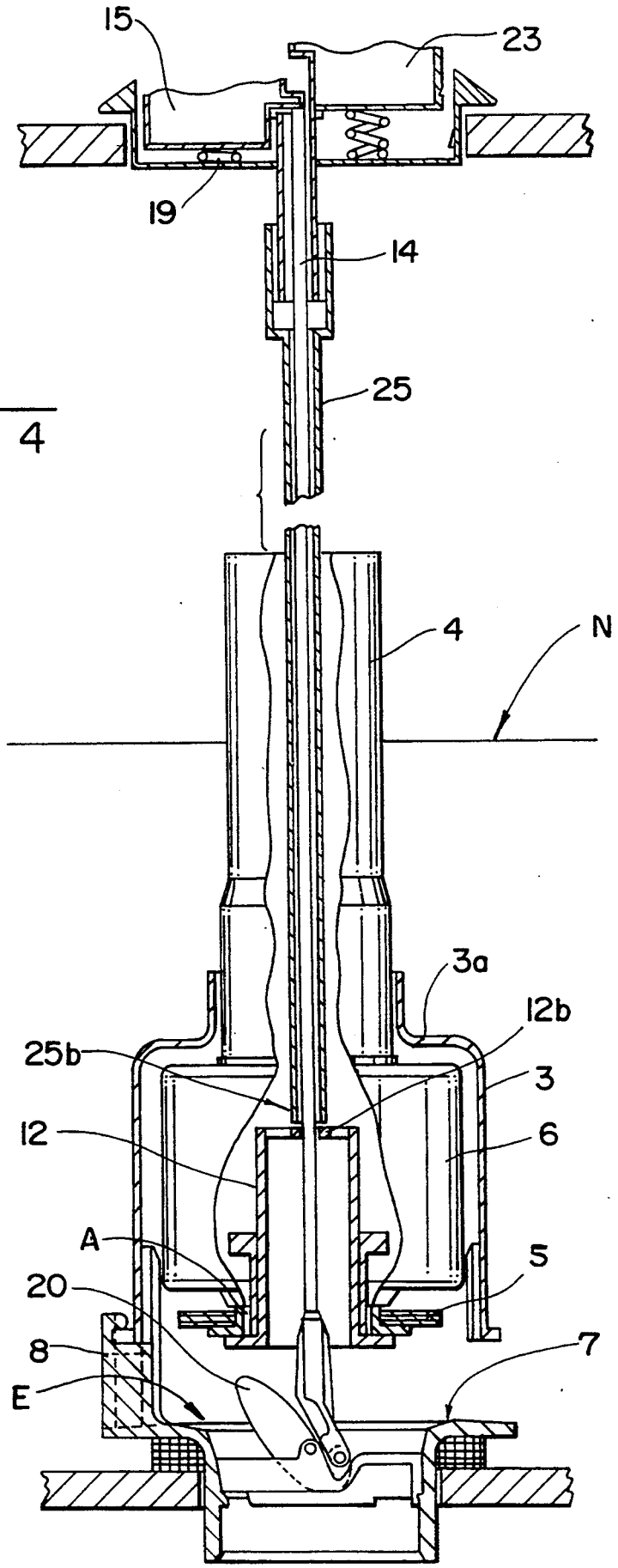
FIG. 4 is a longitudinal cross-sectional view illustrating the mobile assembly in an elevated, after activation of the push-button controlling the complete evacuation of the tank.

The annexed drawings will be referred to in describing two advantageous, although non-limiting embodiments of the flushing mechanism according to the invention, which can be obtained in any plastic material having the requisite qualities.

In the annexed drawings, the elements of the flushing mechanism that are the same or that accomplish identical functions in both embodiments are designated by the same reference numerals.

According to the embodiments illustrated in FIGS. 1–5, the flushing mechanism comprises, an external shell designated in its entirety by the reference numeral 1 and comprising an upper cylindrical guide portion 2, and a lower bulging portion or external bell 3, also cylindrical, and whose diameter is clearly greater than that of said upper guide portion 2, this external shell being adapted to be fixably installed in the flushing tank, as is described hereinafter in the present description.

An "overflow" tube 4 is housed in the external shell 1, in a manner permitting for ascending or descending axial movement. The overflow tube 4 comprises a lower orifice A and an upper orifice B, so as to enable an automatic discharge of a possible overfilling that could, for example, result in a defective closure of the tap controlling entry of water into the tank. A blocking valve 5 of the evacuation orifice of the tank is positioned on the lower end of the overflow tube 4. This valve, for example, forms a water-tight joint in the form of a circular crown and is made of rubber or other similar material, and is installed in a peripheral neck present in a mounting device 4*a* constituting the lower end of the overflow tube 4 and the edge of the opening A.

The lower portion of the overflow tube is arranged or configured so as to constitute a float, which may be advantageously formed by the lower bulging portion 6 of the overflow tube 4. The base of the float is placed above, and slightly spaced from the plane in which the upper surface of valve 5 is located.

Float 6 is housed concentrically in the external bell 3, with a space or annular passage C being reserved between the lateral cylindrical walls of both these elements.

The upper portion of the overflow tube 4 is housed, also concentrically, in the upper portion 2 of external shell 1, which acts as a guide for the upper portion of the overflow tube 4. An annular space D is arranged between the lateral cylindrical walls of the overflow tube and the upper portion of the external shell.

The overflow tube 4, float 6, and valve 5 constitute the mobile assembly of the flushing mechanism.

The seat of valve 5 is constituted by the upper circular edge 7 of a central orifice E with which a cap designated in its entirety by the reference numeral 8 is provided.

The flushing mechanism is positioned inside a tank, affixed to the bowl of a toilet; A cap 8 is affixed by means of a screw (not illustrated) on a lower threaded cylindrical portion 8*a* of the cap, in orifice 9 present in base 10 of the tank (partially represented in FIGS. 1 and 3–5). In this way, central orifice E of cap 8 constitutes the evacuation orifice of the tank. The seal between base 10 of the tank and the seat or support surface of cap 8 is obtained by means of an intermediate annular joint 55 made of rubber or any other adequate material.

The base of external bell 3 and cap 8 are arranged in a complementary manner or provided with complementary junction means enabling them to be assembled rigidly, in a removable manner, and at the same time enabling passage of water between the base and the cap. Cap 8 is, for example, provided with three guiding and latching forks 11 spaced at 120 degrees and between the branches of which base 3*b* of external bell 3 is engaged and retained, the internal branches 11*a* of such latching forks 11 being provided with vertical ribs 11*b* acting as guides to float 6, during vertical movements of such float.

Float 6 is a submersible float. It is equipped with a blocking device 12 which is axially and vertically mobile, this blocking device being housed concentrically in float 6 from which it emerges by its lower portion equipped with a capsular flange 12*a*. This latter element constitutes a valve that can be pressed against its seat 4*a*, constituted by the edge of lower orifice A of the overflow tube, thus ensuring the buoyancy of the float, or be distanced from the seat, so as to enable entry of water into the float, driving the submersion of such float and, consequently, the fall of valve 5 on its seat 7 of central orifice E.

Blocking device 12 advantageously comprises a tubular body, preferably cylindrical, having a tip provided with a punched upper wall, for example, constituted by a transverse bar 12*b* at the center of which a hole 13 is arranged for passage of a transmission rod 14. On the other hand, the tubular body of the blocking device is provided, externally and laterally, with one or several abutment wings 12*c* arranged at a distance from the capsular flange 12*a*, these wings being housed inside float 6.

According to the invention, the flushing mechanism comprises two distinct control systems having push-buttons, that is:

(1) a first push-button control system including a transmission system or gear enabling the lifting of mobile assembly 4-5-6, and, (2) a second push-button control system comprising a transmission system or gear enabling the displacement of the blocking device 12 of submersible float 6, with respect to the latter element.

According to the embodiment illustrated in FIGS. 1–5, the control system enabling the lifting of the mobile assembly 4-5-6, comprises:

(A) a first push-button 15, vertically mobile and housed in a plate 16, adapted to be installed fixably in an opening 17 arranged in cover 18 of the tank;

(B) a spring 19 acting in compression and tending to push push-button 15 towards the outside, that is, upwardly; the spring being for example wedged, by means of its opposing ends, on the one hand, against the lower surface 15*a* of said push-button and, on the other hand, against base 16*a* of plate 16;

(C) a the transmission rod 14 which can be driven in axial translation downwardly, by push-button 15, such transmission rod longitudinally crossing the mobile assembly 4-5-6; and, (D) a lifting element 20 mounted with an ability to pivot at the lower end of transmission rod 14 and arranged beneath valve 5 and capsular flange 12*a* of the blocking device; this lifting element is, for example, constituted by a cam or a small lever of the first type whose oscillational axis 21 is borne by a cross-bar 22 located fixably through the evacuation orifice E of cap 8, beneath seat 7 of valve 5.

Seat 7 of valve 5 and the upper edge of the resistance arm of lifting element 20 are positioned reciprocally, such that when the mobile assembly 4-5-6 is in the lower inactive position, it rests, by means of the lower surface of the valve on the edge of evacuation orifice E, whereas the capsular flange 12*a* is slightly distanced from its seat 4*a*, so as to maintain a space between it and the seat and to open the lower overflow orifice A, the capsular flange resting on the upper edge of the resistance arm of rocking lever 20, as has been described in FR-A-2,658,844.

The transmission rod 14 can be affixed translationally to push-button 15 or its upper end can be simply placed beneath one portion of the said push-button so as to be displaced axially downwardly, when pressure is exerted on the said push-button. According to the example illustrated, push-button 15 comprises a drive pin 15*b* arranged above the upper end of rod 14, in contact, or at a very small distance from the end.

The control system enabling the displacement of blocking device 12 of submersible float 6 with respect to the float comprises:

(2*a*) a second push-button 23 vertically mobile and housed in plate 16, (2*b*) a spring 24 acting in compression and tending to push back push-button 23 towards the outside, that is, upwardly; this spring being for example wedged, by means of its opposing ends, on the one hand, against the lower surface 23*a* of the push-button and, on the other hand, against base 16*a* of plate 16; and, (2*c*) a tubular thruster rod 25, arranged about the transmission rod 14, and which can be driven in axial translation downwardly, by push-button 23; the lower end 25*b* of such rod being located above and at a distance from peak 12*b* of blocking device 12, in the resting position of the mechanism. Additionally, this rod is dimensioned such that in the active position, it limits the upward displacement of blocking device 12, with respect to that of float 6.

The tubular thruster rod 25 is affixed translationally to push-button 23, to which it may be, for example, linked in a removable manner via an assembly of the groove and T-tenon type. On the other hand, this tubular thruster rod may advantageously be obtained in two portions assembled by a threading 25*a*, so as to allow an adjustment of the length of said rod.

According to an important characteristic of the invention, the push-buttons are configured and arranged so that:

1. the pressing of push-button 15 does not exert any action on push-button 23;

2. while the pressing of push-button 23 automatically results in the pressing of push-button 15.

According to the embodiments illustrated in FIGS. 1–5, push-button 23 comprises a pin 23*b* arranged above and practically in contact with pin 15*b* of push-button 15.

According to another characteristic arrangement of the invention, means are provided to momentarily immobilize the control system for lifting the mobile assembly 4-5-6 and the control system for positioning the blocking device 12, in their open position.

According to the embodiment illustrated in FIGS. 1–5, these means are constituted by a complementary arrangement of plate 16 and of push-button 23. For example, the peripheral wall of plate 16 can be provided with a small tooth or hump 26 (i.e. protrusion) adapted to cooperate with an indention or notch 27 with which push-button 23 is laterally provided.

To enable them to be distinguished from another, push-buttons 15 and 23 can have different colors, or comprise, on their upper surface a reference or literal or graphic symbol enabling them to be identified immediately.

We will now explain the functioning of the dual control flushing mechanism that has just been described.

During the filling or inactive period (i.e., as illustrated in FIG. 1):

(1) the mobile assembly 4-5-6 is in a lowered position, valve 5 resting on its seat 7 and blocking evacuation orifice E; on the other hand, push-button 15 and transmission rod 14 are in a raised position;

(2) the capsular flange 12*a* of blocking device 12 is slightly distanced from its seat 4*a* and rests on the resistance arm of blocking lever 20; on the other hand, push-button 23 and thruster rod 25 are in the raised position.

At the end of the filling, the level N of water contained in the tank is generally a little below the position at which the upper end of the overflow tube 4 is located, such that it can fulfill its function in case of defective closure of the supply tap. Water also fills spaces C and D.

When one wishes to undertake a complete evacuation of the tank, by pressing push-button 15, one brings about the fall of the lower end of transmission rod 14, and the rocking of lever 20 whose resistance arm pivots upwardly, resulting in firstly, the lifting of blocking device 12 that closes orifice A and, secondly, the lifting of valve 5 of mobile assembly 4-5-6. Water flows toward evacuation orifice E through the openings arranged between the base of bell 3 and the upper surface of cap 8, and, by passing beneath float 6, communicates an additional lifting movement to the latter whose upward displacement is stopped by peak 3*a* of external bell 3 against which the upper portion of the float comes into abutment (FIG. 4), the blocking device 12 remaining pressed against its seat by the pressure of the water that cannot enter the float.

When push-button 15 is released, it rises under the action of spring 19, resulting in a corresponding rising movement of transmission rod 14, if such transmission rod is mechanically linked to the push-button, whereas rocking lever 20 takes its initial position, or it does not modify the position of the rod and of the lever, in the inverse case.

During a total evacuation of the tank, mobile assembly 4-5-6 remains in a raised position, as long as the buoyancy of float 6 remains ensured; at the end of the evacuation, the level of water decreases progressively and the mobile assembly falls back naturally into its resting position (FIG. 1) when there is no longer any water in the tank and the buoyancy of the float is no longer ensured. Valve 5 is once again pressed on its seat 7 and closes the vacuation orifice; on the other hand, the fall of the float drives the pivoting of lever 20 downwardly and the rise, once again, of rod 14, if the latter element is not linked to push-button 15.

When one wishes to obtain partial evacuation or a semi-evacuation of the tank, one presses on push-button 23, resulting in the simultaneous pressing of push-button 15.

Figure 5:
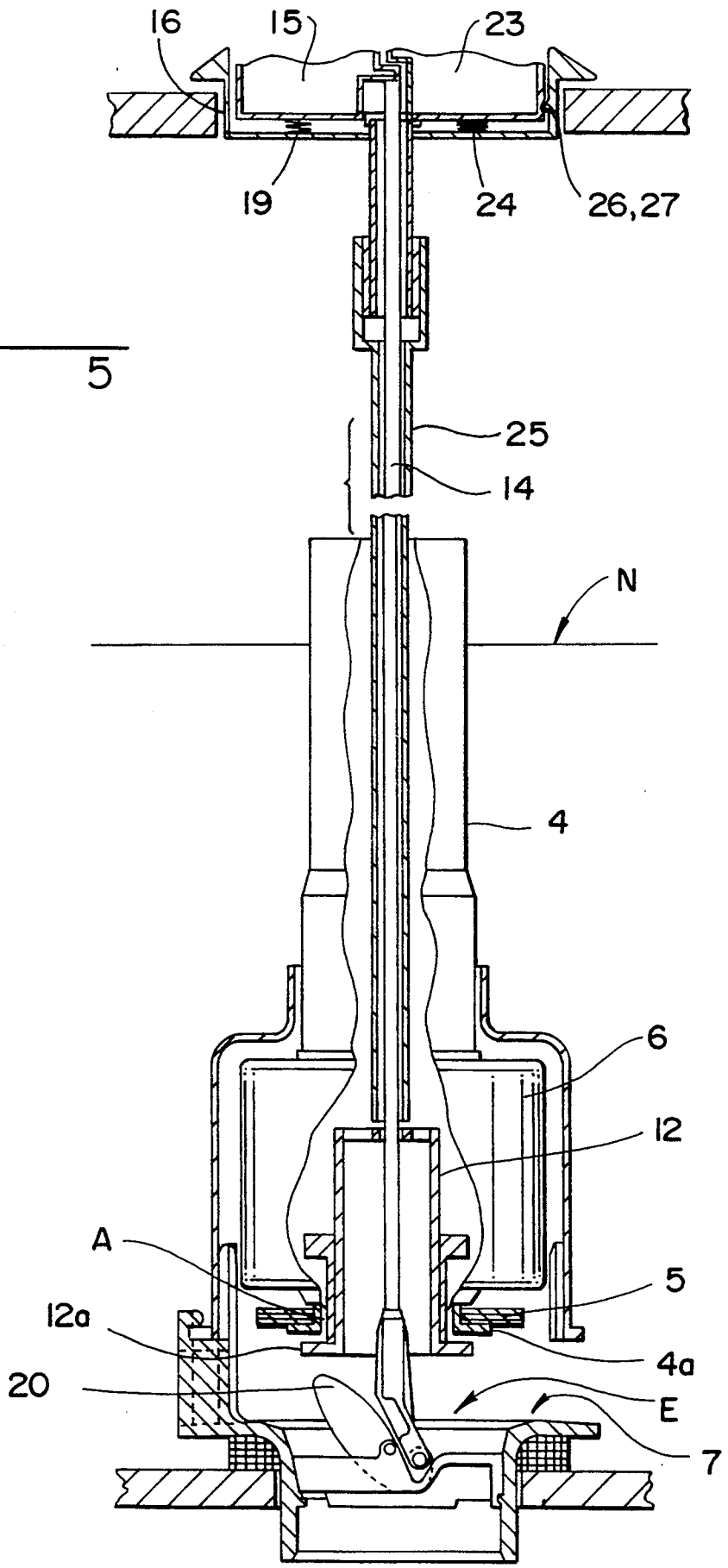
FIG. 5 is a longitudinal cross-sectional view illustrating the mobile assembly in an elevated position, and the blocking device of the submersible float in an open position, after activation of the push-button controlling the semi-evacuation (or partial evacuation) of the tank.
Figure 6:
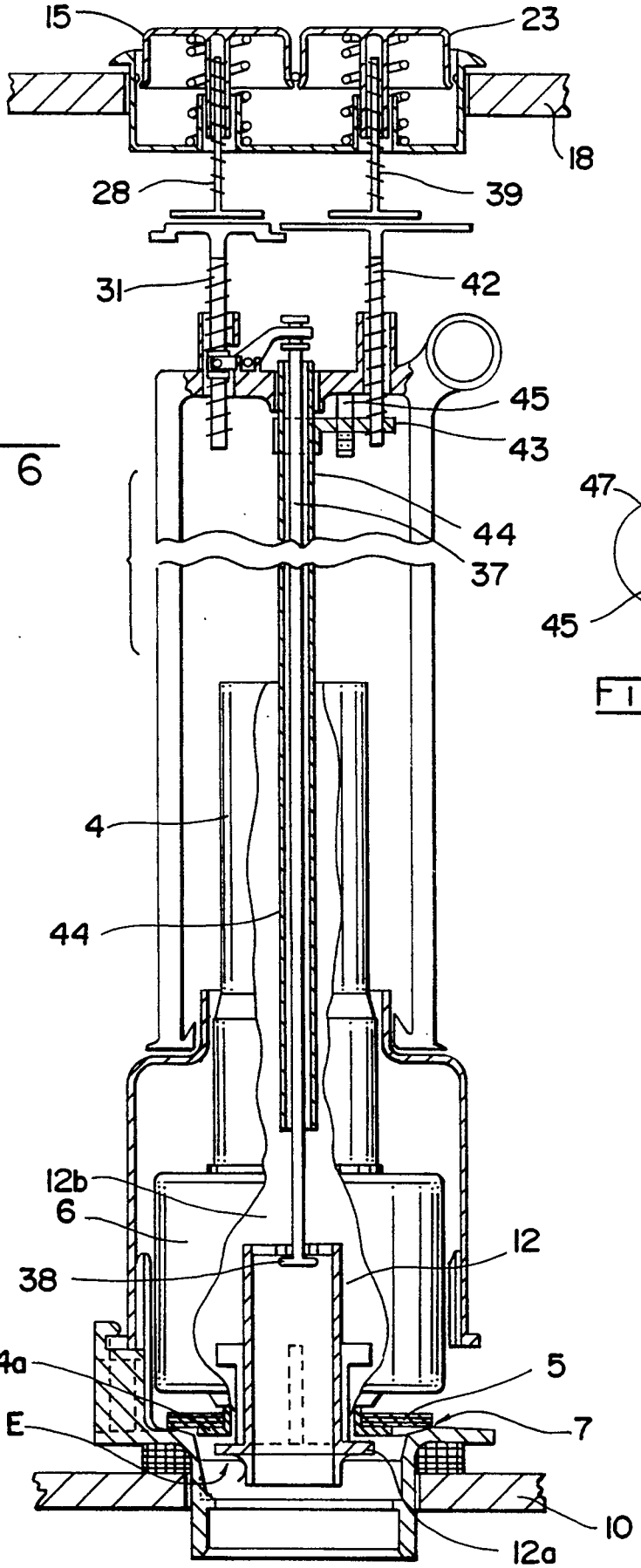
FIG. 6 is a longitudinal cross-sectional view of an alternative embodiment of the apparatus of the invention, in which the base and cover have only been partially represented, said mechanism illustrated in the resting position.
Figure 6A:
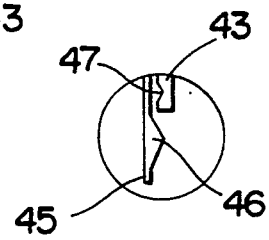
FIG. 6A illustrates an enlarged view of the means enabling momentary immobilization of the control system for lifting the mobile assembly and the control system for displacing the blocking device in their open position.
Figure 7:
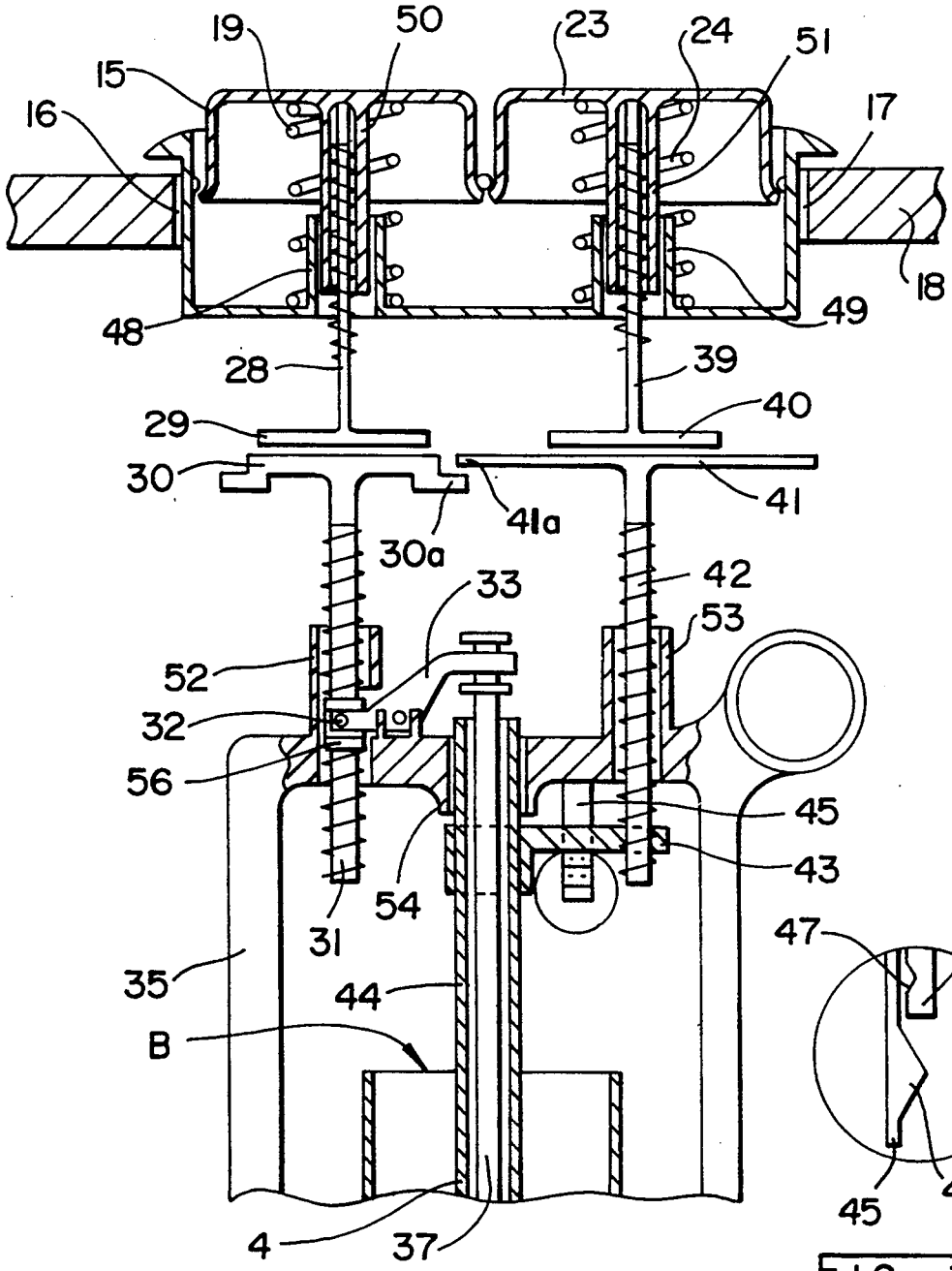
FIG. 7 is a longitudinal cross-sectional enlarged view of the apparatus of the invention, illustrating the upper portion of the internal mechanism.
Figure 7A:
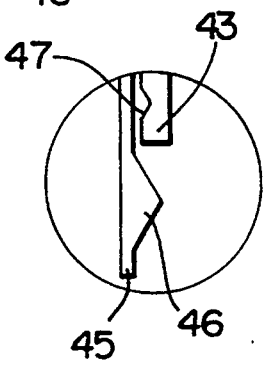
FIG. 7A illustrates an enlarged view of the means enabling momentary immobilization of the control system for lifting the mobile assembly and the control system for displacing the blocking device in their open position.
Figure 8:
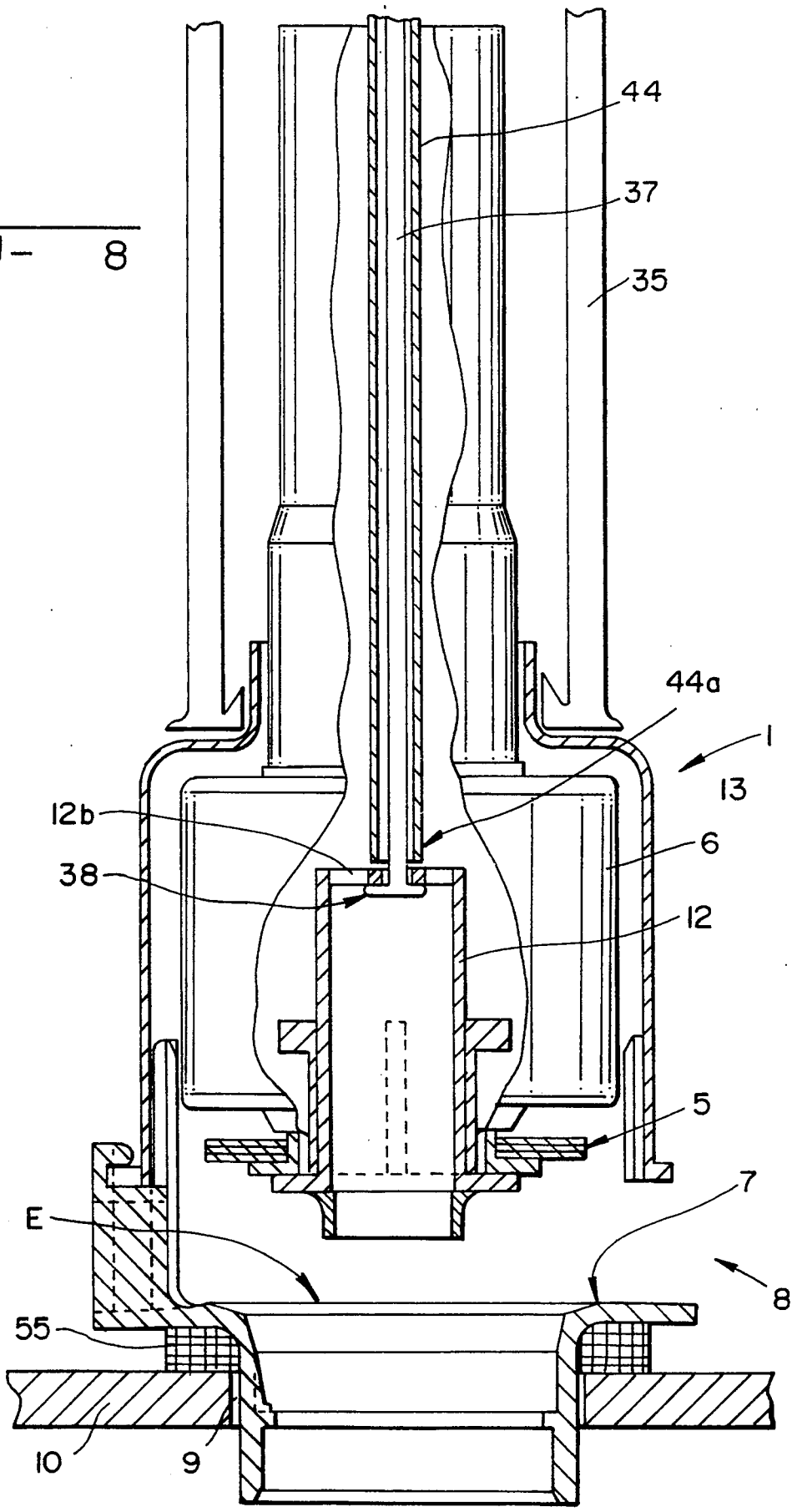
FIG. 8 is a longitudinal cross-sectional enlarged view of a lower portion of an apparatus according to the present invention, illustrating a mechanism comprising a mobile assembly represented in a position and in a situation consequent to the activation of the control button for a complete evacuation of the tank.

The pressing of push-button 15 ensures the lifting of mobile assembly 4-5-6, as has been described hereinabove, whereas the pressing of push-button 23 and the descending displacement of rod 25 have the effect of limiting the upward movement of blocking device 12 with respect to that of float 6, such that the capsular flange 12*a* of the blocking device is distanced from its seat 4*a*, resulting in the opening of lower orifice A of the float (FIG. 5). The float is thus quickly filled with water. During this filling, the two control systems are immobilized in an open position by the action of the latching device 26–27.

When water fills float 6, the buoyancy of such float is no longer ensured, and it falls under the effect of its own weight, by bringing about, other than the closure of evacuation orifice E and the interruption of the evacuation process, the rocking of the resistance arm of lever 20 upwardly, the lifting of transmission rod 14 that pushes push-button 15 upwardly, which in turn pushes push-button 23 upwardly, bringing about the unlatching of the momentary immobilization device 26–27. Spring 19 then ensures the complete lifting of push-button 15, whereas spring 24 ensures the complete lifting of push-button 23 and that of thruster rod 25. On the other hand, after the fall of float 6, capsular flange 12*a* of blocking device 12 remains distanced from its seat 4*a*, and this maintains orifice A in an open position and enables the evacuation of float 6.

According to the embodiment illustrated in FIGS. 6–11, push-button 15 of the control system enabling lifting of mobile assembly 4-5-6, drives a transmission rod arranged vertically. In an advantageous manner, this transmission rod is obtained in two separate portions. The upper portion or rod 28 is linked to push-button 15 and its lower end is provided with a disc-shaped support sole 29. The lower portion or rod 31 is located in alignment with the preceding element and its upper end is provided with a disc-shaped drive plate 30. In the resting position, sole 29 is located above and at a very small distance or in contact with plate 30.

On the lower rod 31 is fixed, by means of a joint 32, one of the ends of a pivoting lever 33 fixed, by means of joint 34, on a mounting device 35 shaped like a gate, rigidly affixed to external shell 1 of the mechanism. The other end of the pivoting lever 33 is connected, by joint 36, to the upper end of a drive shaft 37. The lower end of this drive shaft crosses passage 13 arranged in the upper bar 12*b* of the blocking device 12, and it is provided with a traction heel 38 enclosed inside the body of the blocking device.

On the other hand, push-button 23 of the control system, which enables the displacement of blocking device 12 of submersible float 6, drives a vertically-positioned transmission rod. This transmission rod is also, a preferred embodiment, in obtained in two separate portions. The upper portion of rod 39 is assembled to push-button 23 and its lower end is provided with a disc-shaped support sole 40. On the other hand, the lower portion or rod 42 is arranged in alignment with rod 39 and its upper end is provided with a disc-shaped drive plate 41.

In the resting position, sole 40 is located above and at a very small distance, or in contact with drive plate 41. In this position, a portion 41*a* of the periphery of head 41 is placed above and at a very small distance or in contact with a portion 30*a* of the periphery of head 30.

The lower end of the lower rod 42 is linked (preferably rigidly connected) to a lateral arm 43 oriented horizontally, which is, on the other hand, affixed to the upper portion of a tubular thruster rod 44 arranged about drive shaft 37 the lower end 44*a* of this thruster rod is arranged above and at a distance from the upper bar 12*b* of blocking device 12, in the resting position of the mechanism.

On the other hand, the thruster rod 44 is dimensioned so that in the active position, it limits the upward displacement of blocking device 12 with respect to the ascending movement of float 6.

According to the embodiments illustrated in FIGS. 6–11, and as shown in FIGS. 6A, 7A, 9A, 10A and 11A, the means enabling the momentary immobilization of the control system for lifting the mobile assembly 4-5-6 and the control system for displacing the blocking device 12, in their open position, comprise a complementary arrangement of lateral arm 43 and a vertical tongue 45, oriented downwardly, with which mounting device 35 is provided, at its upper portion. For example, tongue 45 can be provided with a small tooth or hum 46 (i.e., a protrusion) adapted to cooperate with an indentation or notch 47 with which arm 43 is provided laterally.

Means are provided to ensure the guidance of the rods of the two control systems.

For the upper rods 28 and 39, these means are, for example, constituted by small wells 48, 49 with which the base of plate 16 is provided, and in which sleeves 50 and 51 attached to the lower surface of push-buttons 15 and 23 can slide, and in which the upper end of the upper rods 28 and 29 are respectively engaged.

The lower rods 31, 42 are guided by passages having vertical axes 52, 53 respectively, arranged in the upper portion of mounting device 35.

The upper end of thruster rod 44 is guided in a collar having a vertical axis 54 present in the upper portion of the mounting device.

The transmission rods 28–31 and 39–42 are affixed in an adjustable manner to the elements to which they are attached. To this end, the upper transmission rods 28 and 39 are assembled by screwing to sleeves 50, 51 of push-buttons 15, 23 respectively. On the other hand, the lower transmission rod 31 is assembled, by screwing, to a nut 56 that bears the journal axis 32 of lever 33, whereas the lower transmission rod 42 comprises a threading by means of which it is fixed in a screw thread having a vertical axis with which arm 43 is provided.

The operation of this dual control flushing mechanism is as follows:

In the filling or inactive period (FIG. 6):

A. The mobile assembly 4-5-6 is in the lowered position, valve 5 resting on its seat 7 and blocking evacuation orifice E; on the other hand, push-button 15, upper rod 28 and lower rod 31 are in a raised position, while the drive shaft 37 is in a lowered position;

B. The capsular flange 12*a* of blocking device 12 is slightly distanced from its seat 4*a*, the blocking device being suspended at shaft 37;

C. Push-button 23, upper rod 39, lower rod 42, and thruster rod 44 are in a raised position, the lower end 44*a* of the thruster being located at a distance from the bar or punched upper wall 12*b* of blocking device 12.

Figure 9:
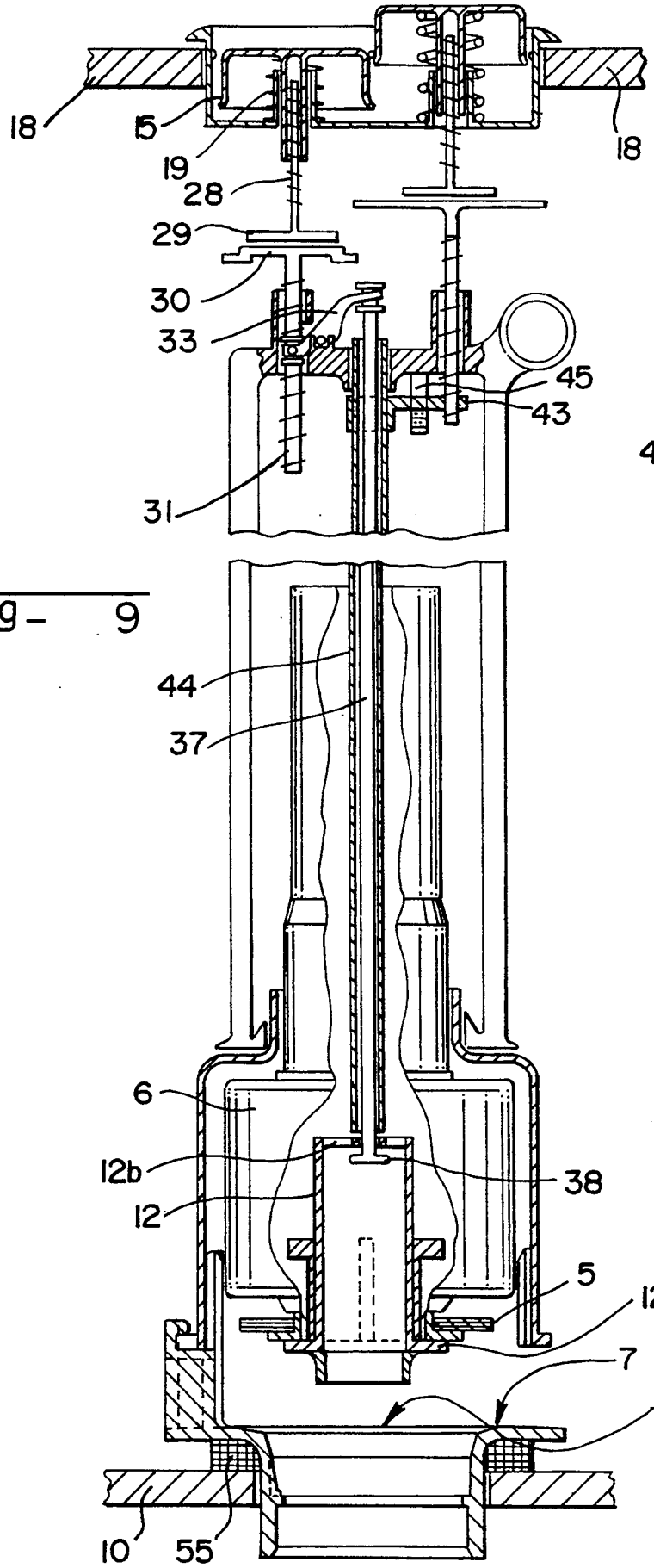
FIG. 9 is a longitudinal cross-sectional view of an apparatus according to the invention, illustrating the mobile assembly in an elevated position, after activation of the push-button controlling the complete evacuation of the tank.
Figure 9A:
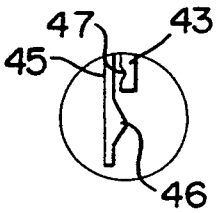
FIG. 9A illustrates an enlarged view of the means enabling momentary immobilization of the control system for lifting the mobile assembly and the control system for displacing the blocking device in their open position.
Figure 10:
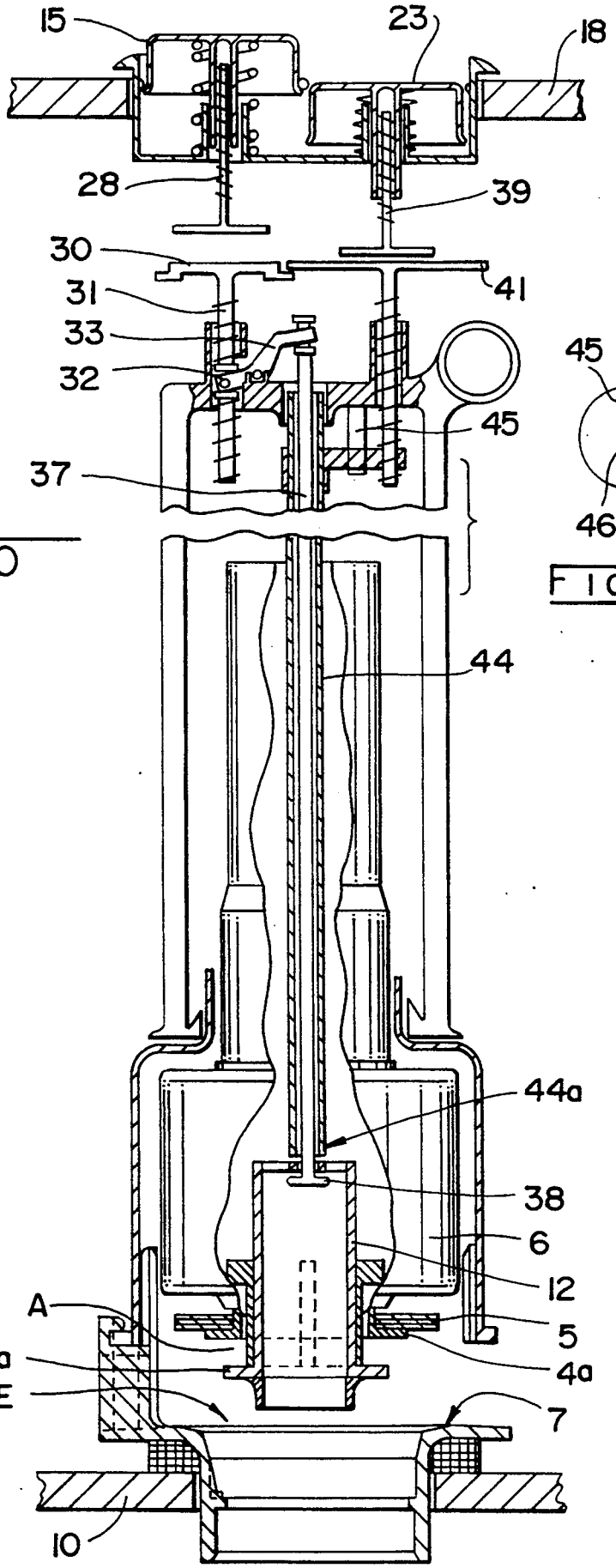
FIG. 10 is a longitudinal cross-sectional view of an apparatus according to the invention, illustrating the mobile assembly in an elevated position and the blocking device in an open position, during activation of the push-button controlling the semi-evacuation or partial evacuation of the tank.
Figure 10A:
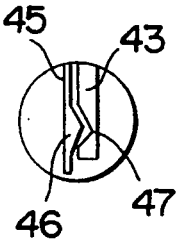
FIG. 10A illustrates an enlarged view of the means enabling momentary immobilization of the control system for lifting the mobile assembly and the control system for displacing the blocking device in their open position.

When one wishes to undertake a complete evacuation of the tank, pressure is exerted on push-button 15, which brings about the fall of upper rod 28 and lower rod 31, the rocking of pivoting lever 33 and the axial upward displacement of drive shaft 37, which, by means of its heel 38, exercises a tractional force on the upper bar 12*b* of blocking device 12, which, by means of its capsular flange 12*a* ensures the lifting of mobile assembly 4-5-6 enabling evacuation of the water contained in the tank (FIG. 9).

When push-button 15 is released, it rises under the action of spring 19, without having any effect on the other elements of the control mechanism.

During a complete evacuation of the tank, mobile assembly 4-5-6 remains in a raised position as long as the buoyancy of float 6 remains ensured; at the end of the evacuation, the level of water falls progressively and the mobile assembly falls back naturally into its resting position (FIG. 6) when there is no longer any water in the tank and the buoyancy of the float is no longer ensured. The fall of the mobile assembly results in a downward axial movement of drive shaft 37, the rocking of the pivoting lever 33 in an inverse direction, and the rise of lower rod 31 whose plate 30 is repositioned just beneath or in contact with sole 29 of upper rod 28.

When one wishes to obtain a semi-evacuation or a partial evacuation of the tank, push-button 23 is pressed, bringing about (FIG. 10) the fall of the upper rod 39 which simultaneously results in: on the one hand, the fall of lower rod 42, and on the other hand, the fall of lower rod 31 which is in fact driven downwardly by the support exerted on its head 30 by head 41 of rod 42.

The downward axial displacement of lower rod 31 drives, as indicated previously, the lifting of the mobile assembly 4-5-6.

On the other hand, the fall of the lower rod 42 brings about a downward axial movement of thruster rod 44 which has the effect of limiting the upward axial movement of blocking device 12 with respect to that of float 6, such that the capsular flange 12*a* of the blocking device is distanced from its seat 4*a*, which has the effect of opening lower orifice A of the float. This float is thus quickly filled with water. During the filling, the two control systems are immobilized in their open position by the action of latching device 46–47.

When water fills float 6, the buoyancy of such float is no longer ensured and it falls under the effect of its weight and its ballast, ensuring closure of the evacuation orifice E and interruption of the evacuation process. The fall of mobile assembly 4-5-6 results in, as indicated previously, the downward axial movement of drive shaft 37, the rocking in an inverse direction of lever 33, and the lifting of lower rod 31. On the other hand, the lifting of lower rod 31 also ensures the lifting of lower rod 42, the head 41 of the latter being, in fact, pushed upwardly by the underlying edge of head 30 of the first; the force of this thrust being clearly greater than the retention force exerted by the latching means 46–47, the latter elements are neutralized (see details of FIG. 11), and the lifting of the lower transmission rod 42 results in an upward axial movement of the tubular thruster rod 44 to which it is affixed.

When push-button 23 is released, immediately after having pressed it, it rises under the action of spring 24, without exerting any influence whatsoever on the position of the other elements of the dual control system.

Figure 11:
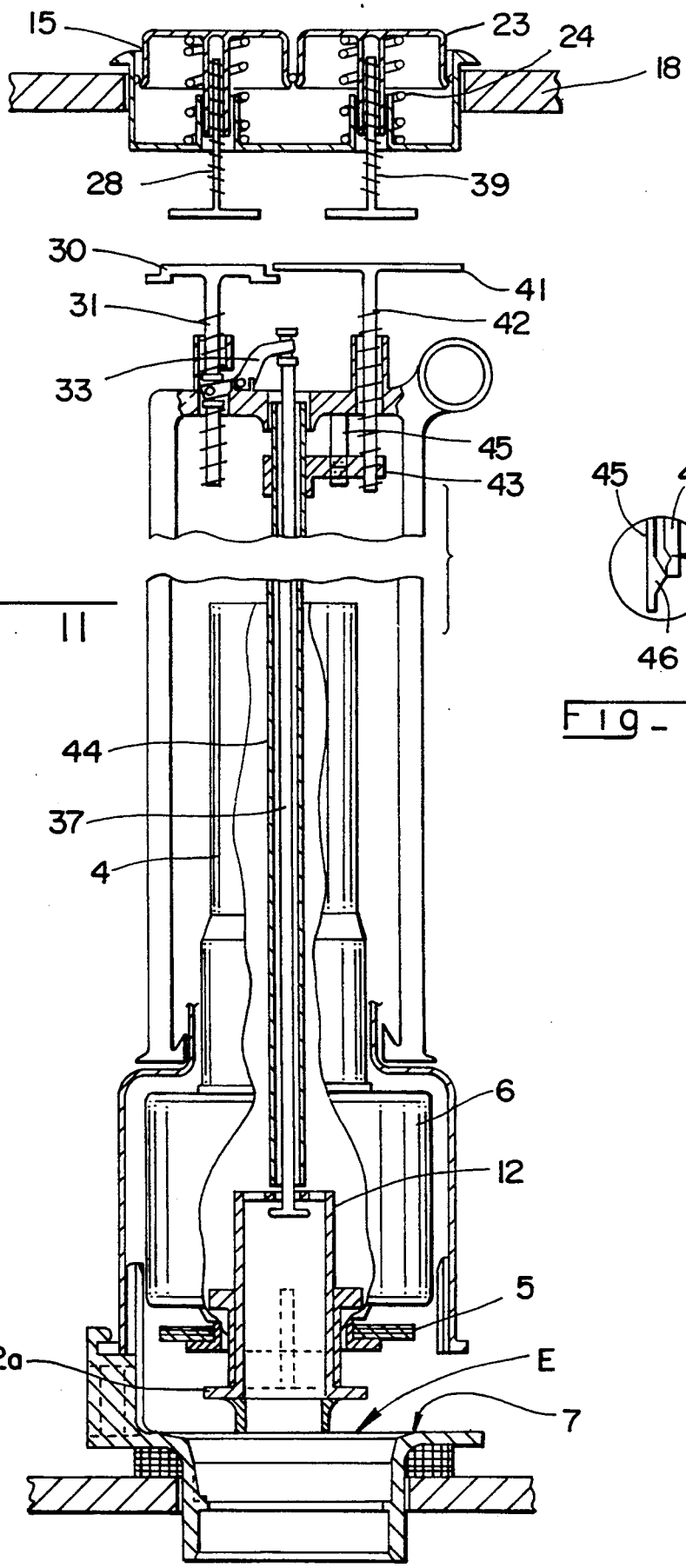
FIG. 11 is a longitudinal cross-sectional view of an apparatus according to the invention, illustrating the position of various elements of the flushing mechanism, after the push-button controlling the opening of the blocking device has been released, in the instant that precedes the fall of the mobile assembly.
Figure 11A:
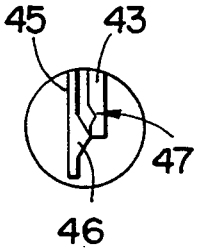
FIG. 11A illustrates an enlarged view of the mans enabling momentary immobilization of the control system for lifting the mobile assembly and the control system for displacing the blocking device in their open position.

It must be noted that by virtue of the absence of a mechanical connection between the upper rods 28, 39, the lower rods 31, 42, respectively, one can press down on one or the other of the push-buttons 15 and 23 without either influencing the position of the other elements of the dual control system or the flushing process as it takes place, as can be seen better in FIG. 11. The volumes of water evacuated are constant and evacuation cannot be interrupted when push-button 23 is activated.

Float 6, blocking device 12, and annular passage A arranged between the body of the blocking device and the edge of the lower opening of the overflow tube, are dimensioned such that the filling of the float and its fall after the passage has been opened occurs in a period of time corresponding to the evacuation of half of the available volume of water contained in the tank.

I claim:

1. A dual-control flushing apparatus for selective operation of a complete or partial evacuation of a flushing tank having an evacuation orifice, comprising:

an axially-displaceable mobile assembly having a blocking valve, means for movably mounting said assembly in said flushing tank whereby said blocking valve blocks and unblocks said evacuation orifice of the flushing tank; said assembly further including an overflow tube having an upper portion with an upper orifice and a lower portion with a lower orifice, said lower portion of said overflow tube comprising a float located above said blocking valve, said float being submersible;

a blocking device positioned partially within said float and axially movable therein and adapted to be pressed against a seat formed by an edge of said lower orifice of said overflow tube into a closed position, so as to stop entry of water into said float, first and second push button control systems, said second push button control system including a thruster rod operatively connected to said blocking device for spacing said blocking device from said seat into an open position by a force exerted by said thruster rod associated with said second push-button control system;

said first push-button control system comprising a first transmission system for lifting said mobile assembly to unblock said evacuation orifice for a complete evacuation of the flushing tank, and said second push-button control system comprising a second transmission system including said thruster rod for enabling the positioning of said blocking device into said open position so as to enable entry of water into said float, thereby causing said float to fall and interrupt a flushing process for a partial evacuation of the flushing tank, said first push-button control system and said second push-button control system being arranged so that activation of a first push-button of said first push-button control system for a complete evacuation does not result in any action on said second push-button control system, and activation of a second push-button of said second push-button control system for a partial evacuation activates said first push-button control system for lifting said mobile assembly.

2. The dual control flushing apparatus as described in claim 1, further comprising a momentary blocking means for maintaining said first push-button control system and said second push-button control system in an open position during entry of water into said float, so that said float can descend.

3. The dual control flushing apparatus as described in claim 1, wherein said float, said blocking device, and said lower orifice of said overflow tube are dimensioned so that filling and descending of said float occurs in a time corresponding to evacuation of approximately half of an available volume of water in the tank.

4. The dual control flushing apparatus as described in claim 1, wherein said first transmission system comprises a transmission rod and said second transmission system comprises said thruster rod, said thruster rod being coaxially arranged around said transmission rod, said transmission rod enabling the lifting of said mobile assembly, and said thruster rod enabling the positioning of the blocking device in the open position.

5. The dual control flushing apparatus as described in claim 4, wherein said thruster rod is dimensioned so that upon activation of said second push-button control system, said thruster rod limits upward displacement of said blocking device with respect to said float.

6. The dual control flushing apparatus as described in claim 4, wherein said thruster rod comprises of separate upper and lower rod portions threadedly coupled together to provide an adjustable length for said thruster rod.

7. The dual control flushing apparatus as described in claim 4, wherein said second push-button on said second push-button control system for positioning the blocking device comprises a portion located above or overlapping a part of said first push-button on said first push-button control system for lifting said mobile assembly.

8. The dual control flushing apparatus as described in claim 4, wherein said transmission rod enabling the lifting of said mobile assembly is directly activated by said first push-button of said first push-button control system, said first push-button comprising a portion located above and in a vicinity of an upper end of said transmission rod.

9. The dual control flushing apparatus as described in claim 8, wherein said first push-button comprises a portion located above and in contact with said upper end of said transmission rod.

10. The dual control flushing apparatus as described in claim 4, wherein said thruster rod for positioning the blocking device is translationally affixed to said second push-button.

11. The dual control flushing apparatus as described in claim 10, wherein said thruster rod is affixed to said second push-button by a groove and T-tenon assembly.

12. The dual control flushing apparatus as described in claim 2, wherein said momentary blocking means comprise a complementary arrangement of said second push-button and a plate housing said second push-button, said complementary arrangement comprising a protrusion provided on a peripheral wall of said plate, and a complementary indentation arranged laterally in said second push-button.

13. The dual control flushing apparatus as described in claim 1, wherein said first push-button control system for lifting said mobile assembly comprises a first transmission rod and a first drive plate, and said second push-button control system for opening said blocking device comprises a second transmission rod and a second drive plate, said second drive plate of said second push-button control system comprising a portion located above and overlapping a portion of said first drive plate.

14. The dual control flushing apparatus as described in claim 13, wherein:

said first transmission rod comprises an upper portion and a lower portion, said upper and lower portions of said first transmission rod being separate from one another, said upper portion of said first transmission rod being connected to said first push-button, said lower portion of said first transmission rod being connected to a first activation rod, an upper end of said lower portion of said first transmission rod bearing said first drive plate; and said second transmission rod comprises an upper portion and a lower portion, said upper and lower portions of said second transmission rod being separate from one another, said upper portion of said second transmission rod being connected to said second push-button, said lower portion of said second transmission rod being connected to a second activation rod, an upper end of said lower portion of said second transmission rod bearing said second drive plate.

15. The dual control flushing apparatus as described by claim 13, wherein said first and second transmission rods are each adjustable with respect to their respective drive plates and push-buttons.

16. The dual control flushing apparatus as described in claim 14, wherein said first push-button control system for lifting said mobile assembly comprises a rocking lever activated by said first transmission rod connected to an upper portion of said first activation rod, with a lower portion of said first activation rod slidably engaged within a passage arranged in an upper wall in said blocking device, said lower portion of said first activation rod having a heel enclosed inside said blocking device.

17. The dual control flushing apparatus as described in claim 14, wherein said second push-button control system for opening the blocking device comprises an arm rigidly connecting said lower portion of said second transmission rod to said second activation rod.

18. The dual control flushing apparatus as described in claim 17, said means for movably mounting said assembly further comprises a mounting device having an upper portion providing guides for said first and second transmission rods, and said mounting device also connected to said rocking lever.

19. The dual control flushing apparatus as described in claim 18, wherein said momentary blocking means comprises a complementary arrangement between said mounting device and said arm.

20. The dual control flushing apparatus as described in claim 19, wherein said complementary arrangement between the mounting device and the arm comprise a protrusion and an indentation.

21. The dual control flushing apparatus as described by claim 1, comprising a first spring for returning said first push-button to an elevated position, and a second spring for returning said second push-button to an elevated position.

* * * * *

UNITED STATES PATENT AND TRADEMARK OFFICE

CERTIFICATE OF CORRECTION

PATENT NO. : 5,331,690
DATED : July 26, 1994
INVENTOR(S) : Michel POURCIER

It is certified that error appears in the above-indentified patent and that said Letters Patent is hereby corrected as shown below:

At column 1, line 22, delete "thus".
At column 1, between lines 44 and 45, insert ---SUMMARY OF THE INVENTION---.
At column 2, line 34, change "herein above" to ---hereinabove---.
At column 2, line 58, change "elevated" to ---elevated position---.
At column 5, line 42, delete "the".
At column 5, line 67, delete "said".
At column 6, line 1, delete "said".
At column 8, line 35, delete "a".
At column 8, line 36, change "preferred embodiment, in" to ---in an interesting manner,---.
At column 8, line 52, change "37" to ---37;---.

Signed and Sealed this

Fourth Day of April, 1995

Bruce Lehman

*Attest:*

BRUCE LEHMAN

*Attesting Officer*

*Commissioner of Patents and Trademarks*